US009901160B2

(12) United States Patent
Donato, Jr.

(10) Patent No.: US 9,901,160 B2
(45) Date of Patent: Feb. 27, 2018

(54) COMBINATION FANNY PACK AND SLING SEAT WITH BACK SUPPORT

(71) Applicant: Robert Casson Donato, Jr., Newark, DE (US)

(72) Inventor: Robert Casson Donato, Jr., Newark, DE (US)

( * ) Notice: Subject to any disclaimer, the term of this patent is extended or adjusted under 35 U.S.C. 154(b) by 135 days.

(21) Appl. No.: 14/842,176

(22) Filed: Sep. 1, 2015

(65) Prior Publication Data

US 2017/0055680 A1 Mar. 2, 2017

(51) Int. Cl.

| | |
|---|---|
| ***A45F 4/02*** | (2006.01) |
| ***A45F 3/00*** | (2006.01) |
| ***A45F 5/02*** | (2006.01) |
| ***A47C 9/10*** | (2006.01) |

(52) U.S. Cl.

CPC ..... *A45F 3/005* (2013.01); *A45F 5/021* (2013.01); *A47C 9/10* (2013.01); *A45F 2003/003* (2013.01); *A45F 2004/026* (2013.01)

(58) Field of Classification Search

CPC ..... A45F 4/02; A45F 4/12; A45F 2004/023
USPC ..... 224/577
See application file for complete search history.

(56) References Cited

U.S. PATENT DOCUMENTS 5,139,187 A * 8/1992 Fowler ..... A41D 13/081 2/162
5,205,448 A * 4/1993 Kester ..... A45C 11/38 206/316.2
5,259,093 A * 11/1993 D'Annunzio ..... A41D 13/0002 224/148.4
5,337,933 A * 8/1994 Nunez ..... A01K 97/06 224/577
5,871,132 A * 2/1999 Hargreaves ..... A41D 13/0537 2/46
6,698,636 B2 * 3/2004 Angus ..... A45F 3/00 224/660
6,971,562 B2 * 12/2005 Willows ..... A45F 5/00 224/148.4
7,201,299 B2 * 4/2007 Forsman ..... A45F 3/14 224/148.2
7,520,412 B2 * 4/2009 Willows ..... A45F 3/14 224/148.4
7,651,016 B2 * 1/2010 Stewart ..... A45F 4/00 2/467
8,510,868 B2 * 8/2013 Mongan ..... A45F 5/021 2/300
8,985,409 B2 * 3/2015 Willows ..... A45F 3/14 224/148.1
2005/0236450 A1 * 10/2005 Iannini ..... B63B 35/7946 224/577
2007/0187444 A1 * 8/2007 Hajari ..... A01M 31/02 224/155
2009/0241235 A1 * 10/2009 Weinreb ..... A41D 15/04 2/84

* cited by examiner

*Primary Examiner* — Brian D Nash

(57) ABSTRACT

A multipurpose fanny pack which is wearable around the waist and providing the wearer with storage compartments, while also having the capability to be removed and converted into an adjustable suspended sling-like seat, and with an adjustable backrest capable of comfortably supporting a user in the seated position, and with a multifunctional material capable of providing a user with multiple configurations of additional comfort and protection from weather and insects.

12 Claims, 18 Drawing Sheets

COMBINATION FANNY PACK AND SLING SEAT WITH BACK SUPPORT

The present invention relates to a multipurpose fanny pack which is capable of carrying and stowing items, while also having the capability of being converted into an adjustable, suspended, sling-like seat with an option of employing an adjustable backrest.

BACKGROUND OF THE INVENTION

Fanny packs are known in the art and widely used in order to carry items when hiking, camping, fishing, hunting, and etc. Also known in the art are portable seating provisions. The usage of a carrying pack along with the desire to carry some sort of portable seating provision is often included in the types of the above mentioned activities. Typically, this requires carrying or wearing separate items, or by wearing a different, more cumbersome item other than a fanny pack, such as a backpack, for example.

Although the use of waist-worn fanny packs for carrying items and wearable packs that can be removed in order to provide seating for a user are known in the art, there is a need for a fanny pack which has an absolute utility over the prior art where it provides the user with an option of being quickly and conveniently removed and converted into an adjustable, suspended, sling-like seat when either one or two fixed points for attachment are available, and while also providing an option to employ an adjustable backrest. Therefore, there is a longstanding need for a new and improved multipurpose fanny pack used to wear around the waist to stow and carry items, while providing a user with the capability of being removed and converted into an adjustable suspended sling-like seat, with or without the use of an adjustable backrest, when the user is provided with either one or two fixed points for attachment.

SUMMARY OF THE INVENTION

A multipurpose fanny pack (here and after known as a fanny pack) consists of at least one first layer of flexible material comprising two long sides and two short sides which are connected together in such a way as to create an elongated inner surface and an elongated outer surface of the layer, and where this first layer will be further defined as the fanny pack's outer layer. Additionally, the fanny pack consists of at least one additional layer of flexible material comprising two long sides and two short sides which are connected together in such a way as to create an elongated inner surface and an elongated outer surface of the layer, which is similar in size and shape as the first layer, and where this additional layer will be further defined as the fanny pack's inner layer. The layers are positioned in a parallel plane to one another, with the elongated inner surfaces of each layer facing one another, and attached at and along the sides in such a way as to create an elongated interior space between the elongated inner surfaces. With two layers attached in this way, the result is two layers (here and after known as the inner layer and the outer layer) creating common long sides and common short sides of the fanny pack, and with a shared interior space between the attached layers. The shared interior space created by the attachment of the inner layer and the outer layer is utilized to contain additional components of the fanny pack.

The fanny pack also comprises various sized pockets and/or compartments which can be opened and closed by means of zippers, hook/loop fastener material, snaps, and etc. The pockets and/or compartments provide the user with the ability to stow and carry items, as well as various components of the fanny pack and fanny pack's seating system. These pockets and/or compartments may be permanently attached to the fanny pack, or made to be removable by means of zippers, hook/loop fastener material, snaps, and etc., and may be located on any side, surface, and/or layer of the fanny pack.

The fanny pack also comprises a length of flexible, strap-like webbing (here and after known as a support strap) having a first end and a second end. The support strap passes through the length of the fanny pack and within the shared interior space created by the attachment of the inner and outer layers of the fanny pack. The support strap is intended to aid in the distribution of weight and to support the seated user. It is envisioned that this support strap may be of any design and configuration resulting in a comfortable and reliable seating provision. For example, a single strap with a width suitable for support and comfort, or a network of multiple straps connected to one another to create a design suitable for support and comfort. Any strap material that is permanently connected and integrated to be part of the support strap is considered to be inclusive of the support strap, and therefore, defined as the support strap. Each of the first and second ends of the support strap terminate within a compartment, located on the outer layer of the fanny pack. This is accomplished by having the support strap ends enter and pass through support strap exit openings which are located within the shared interior space, and are part of the outer layer of the fanny pack. Each of these support strap exit openings are located near each of the short sides of the outer layer of the fanny pack, positioned behind their respective storage compartments, and allowing the support strap ends to pass through the outer layer and enter the inside space of said storage compartments. The support strap ends are capable of remaining stowed within said compartments when not in use, and can be made to exit the compartments from the outer layer perspective when utilizing a seat and backrest. Each of the first and second ends of the support strap includes an adjustable support strap mechanism attached, such as a cam buckle, a strap adjuster, a spring buckle adjuster, and etc., to allow the incorporation and adjustment of an additional strap end. Additionally, each of the first and second ends of the support strap include an attached length of flexible, strap-like webbing (here and after known as a ring straps) each having a first end and second end. The first end of each ring strap is attached to an end of the support strap, and the second end of each ring strap includes a ring hardware, such as a D-ring, an O-ring, a loop ring, and etc. The ring hardware will allow the attachment of backrest attachment mechanisms.

The fanny pack also comprises a layer of flexible padding material which is contained within the length of the shared interior space created by the attachment of the inner and outer layers of the fanny pack. The padding material is intended to provide additional comfort for the user. It is envisioned that this padding material is of similar dimensions of the inner and outer layers of the fanny pack, and may be of any width, length, and thickness which results in a comfortable use of the fanny pack and seat.

The fanny pack is capable of being wrapped around a person's waist and attached to itself in a belt-like manner by means of an adjustable belt connecting mechanism, such as a side-release buckle, a military buckle, a belt buckle, and etc. It is envisioned that the adjustable belt connecting mechanism may be a two-part mechanism where each of the two parts is attached to the second ends of two lengths of flexible, strap-like webbing (here and after known as belt straps), and where the first end of each belt strap is attached at a short side of the fanny pack.

The fanny pack also includes two lengths of flexible, strap-like webbing (here and after known as suspension straps) each having a first end and a second end. The first end of either suspension strap is capable of being united with either of the adjustable support strap mechanisms attached to the ends of the support strap. Each second end of the suspension straps has an attached suspension strap mechanism, such as a snap hook, a spring link, a carabiner, and etc., which is capable of being opened to receive the entire width of the suspension strap, then closed to allow the suspension strap to be captured within the mechanism and slide freely within the mechanism. This allows each of the suspension straps to be wrapped and tightened around a fixed object in a cinching, choker fashion. The user may choose to attach both suspension straps to a single fixed object, such as a tree, or choose to attach each suspension strap to its own, separate fixed object, such as a tree and its branch, or two trees. By utilizing both suspension straps of the fanny pack in this manner, the user converts the fanny pack into an adjustable suspended sling-like seat configuration. The suspension straps may be stowed in at least one of the said compartments when not in use.

The fanny pack also comprises a backrest consisting of a four-sided, flexible material. The four sides are connected in such a way as to create an inner surface and an outer surface of the backrest. The inner and outer surfaces of the backrest are defined as such according to the attachment of the backrest to the fanny pack, and in relation to the fanny pack's inner and outer layers. The backrest is attached along what would be considered as its bottom side, and within a compartment. The compartment is located along the side of the fanny pack that would be considered as the top side of the fanny pack. The backrest can be stowed within said compartment when not in use. A flexible, strap-like webbing (here and after known as a backrest strap) is attached to what would be considered as the top side of the backrest, running the entire length of the backrest, and extending slightly off each side of what would be considered as the right and left sides of the backrest. Each extended end of the backrest strap includes an attached backrest adjusting mechanism, such as a strap adjuster, a strap slide, a clasp buckle, and etc., which is capable of adjusting the backrest strap length to allow the backrest to conform to the seated user. Additionally, the backrest strap ends terminate with an attached backrest attachment mechanism, such as a snap hook, a spring link, a carabiner, and etc., which is capable of being united with the ring hardware incorporated with the support strap ends. It is envisioned that the backrest attachment mechanisms may be of a design which also allows strap length adjustment, and could serve the purpose of backrest strap length adjustment. It is also envisioned that the backrest may be permanently attached to the fanny pack, or made to be removable by means of zippers, hook/loop fastener material, snaps, and etc.

The inner surface of the fanny pack's backrest may include pockets and/or compartments capable of receiving heat packs which could serve the purpose of providing warmth and/or therapeutic comfort for the seated user. The pockets and/or compartments may be opened and closed by means of zippers, hook/loop fastener material, snaps, and etc., and may be included with any other side, surface, and/or layer of the fanny pack.

The outer surface of the fanny pack's backrest includes a compartment containing a flexible, multifunctional material comprising at least two long sides and two short sides which are connected together in such a way as to create an inner surface and an outer surface. The inner and outer surfaces of the multifunctional material are defined as such according to the attachment to the backrest, and in relation to the backrest's inner and outer surfaces. The multifunctional material is attached along what would be considered as its bottom side and within said compartment, and may be stowed within said compartment when not in use. The multifunctional material may be permanently attached within said compartment, or made to be removable by means of zippers, hook/loop fastener material, snaps, and etc. The multifunctional material may be deployed from the compartment and attached at any point along the lengths of the suspension straps when the backrest is deployed and in operation, and the fanny pack is being utilized as a sling-like seat. The attachment of the multifunctional material is accomplished by use of material attachment mechanisms, such as clips, snap hooks, spring links, carabiners, and etc. The multipurpose material may be attached in such a way as to create a backdrop behind the seated user, serving the purpose of camouflage, a wind break, and/or an extension of the backrest in order to further support the seated user, and etc. Alternatively, the multifunctional material may be simply draped over a seated user, or attached to any convenient points available for attachment, such as the utilized suspension straps, branches of a tree or trees, and etc., and in such a way as to be draped over the seated user to serve the purpose of camouflage, a wind break, protection from insects, protection from temperature, weather, and etc. It is envisioned that this multifunctional material may be of any thickness, size, and shape to support the intended use, and may be made from any material, or combination of materials, such as netting, cloth, fabric, nylon, and etc. It is also envisioned that the material attachment mechanisms may be of a design that enables removal and relocation along any point on the sides and/or surfaces of the multifunctional material to provide alternative attachment options, such as double-headed clips, snap hooks, spring links, carabiners, and etc., and may be used in conjunction with a length or lengths of webbing, cord, rope, bungee-cord, shock cord, and etc. in order to support a desired configuration.

The above-mentioned features and advantages of this invention are unique in that they provide a user with an opportunity to conveniently convert a wearable and functional fanny pack into an adjustable suspended sling-like seat when there is either one or two points of attachment available, with or without the use of an optional backrest, with or without the use of pockets to receive heat generating packs, and with or without the use of an optional multifunctional material to provide a user with camouflage, a wind break, additional seating support, protection from insects, protection from temperature, protection from weather, and/or etc. These features and advantages make this device appealing in a way no prior art has been able to accomplish.

DETAILED DESCRIPTIONS OF PREFERRED EMBODIMENTS

Figure 1:
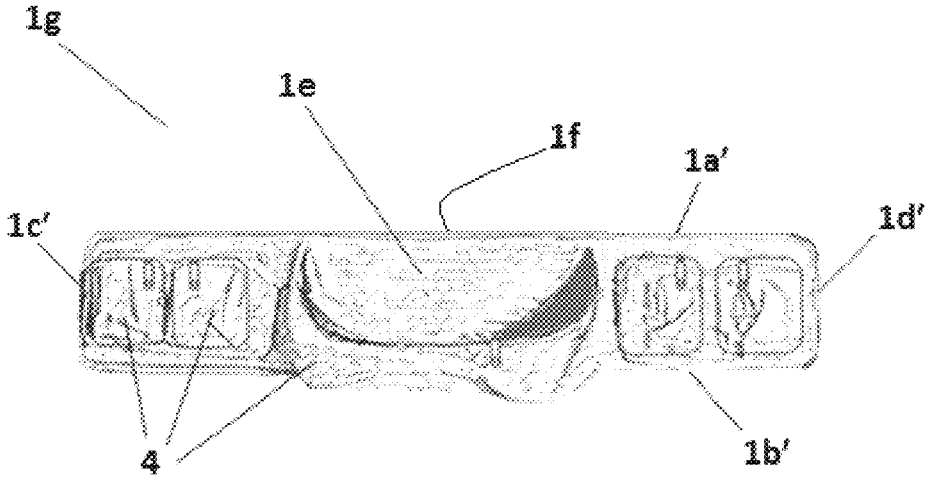
FIG. 1 is a view of a fanny pack's outer layer from the layer's elongated exterior surface perspective.

Referring now to the drawing, there is seen in FIG. 1 a fanny pack's outer layer 1*g*, viewed from the elongated outer surface 1*e* and with the elongated inner surface 1*f* facing away, and shown having two long sides 1*a*' and 1*b*', and two short sides 1*c*' and 1*d*'. Additionally, the figure provides examples of the various sized pockets and/or compartments 4 which are included with the fanny pack's outer layer 1*g*. The pockets and/or compartments 4 are capable of stowing and carrying items, as well as various components of the fanny pack and fanny pack's seating system, and can be opened and closed by means of zippers, hook/loop fastener material, snaps, and etc., and may be made to be removable, by means of zippers, hook/loop fastener material, snaps, and etc. It is envisioned that the outer layer may be of any flexible material suitable for use, such as fabric, canvas, nylon, and etc. It is also envisioned that the pockets and/or compartments may be of any material suitable for use, such as fabric, canvas, nylon, and etc., and may be located on any side, surface, and/or layer of the fanny pack.

Figure 2:
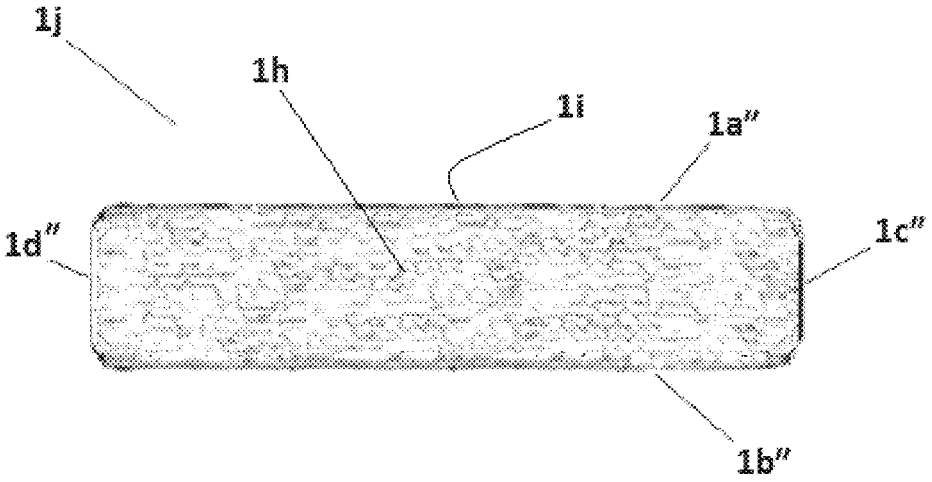
FIG. 2 is a view of a fanny pack's inner layer from the layer's elongated exterior surface perspective.

FIG. 2 shows the fanny pack's inner layer 1*j*, viewed from the elongated outer surface 1*h* and with the elongated inner surface 1*i* facing away, and shown having two long sides 1*a*" and 1*b*", and two short sides 1*c*" and 1*d*". It is envisioned that the inner layer may be of any flexible material suitable for use, such as fabric, canvas, nylon, and etc.

Figure 3:
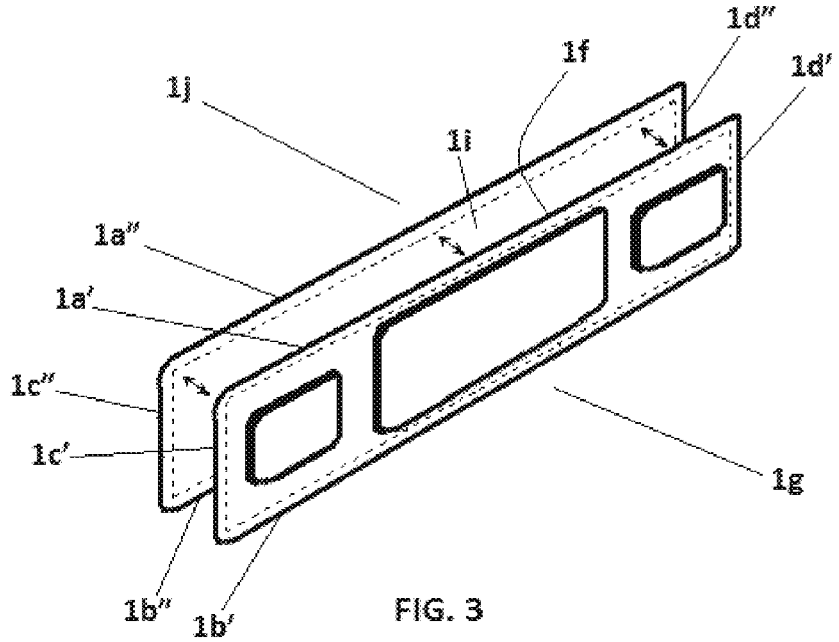
FIG. 3 is a view of the fanny pack's inner and outer layers positioned to show the attachment of the two layers.

FIG. 3 shows attachment of the fanny pack's outer layer 1*g*, and the fanny pack's inner layer 1*j*. The figure shows the elongated inner surfaces 1*f* and 1*i*, of the fanny pack's outer layer 1*g* and the inner layer 1*j*, respectively, facing one another, and positioned according to the attachment of the two layers. The attachment is made at and along the sides of each layer, 1*a*', 1*b*', 1*c*', 1*d*' of the outer layer 1*g*, and 1*a*", 1*b*", 1*c*", 1*d*" of the inner layer 1*j*. The attachment is represented in the figure as segmented lines. This attachment creates a shared interior space between the two layers, and creates common sides, identified as 1*a*, 1*b*, 1*c*, and 1*d* in the subsequent figures. The shared interior space created between the inner layer 1*j* and the outer layer 1*g* is utilized to contain additional components of the fanny pack as shown and defined in FIGS. 4 and 5. It is envisioned that this attachment may be of any design suitable for use, such as stitching, gluing, bonding, zippers, hook/loop fastener material, snaps, and etc.

Figure 3A:
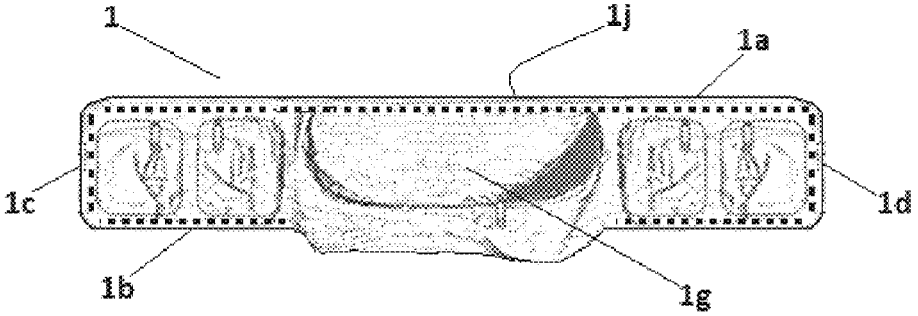
FIG. 3A is a view of the fanny pack's outer layer having been attached to the inner layer, and details the locations of attachment.

FIG. 3A shows the fanny pack 1, shown from the outer layer 1*g* perspective, and with the inner layer 1*j* facing away. The figure shows the attachment at and along the sides 1*a*, 1*b*, 1*c*, and 1*d*. The attachment is represented in the figure as a segmented line.

Figure 3B:
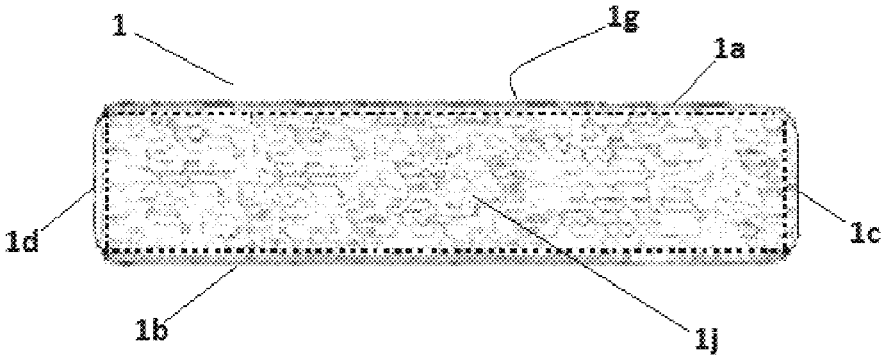
FIG. 3B is a view of the fanny pack's inner layer having been attached to the outer layer, and details the locations of attachment.

FIG. 3B shows the fanny pack 1, shown from the inner layer 1*j* perspective, and with the outer layer 1*g* facing away. The figure shows the attachment at and along the sides 1*a*, 1*b*, 1*c*, and 1*d*. The attachment is represented in the figure as a segmented line.

Figure 4:
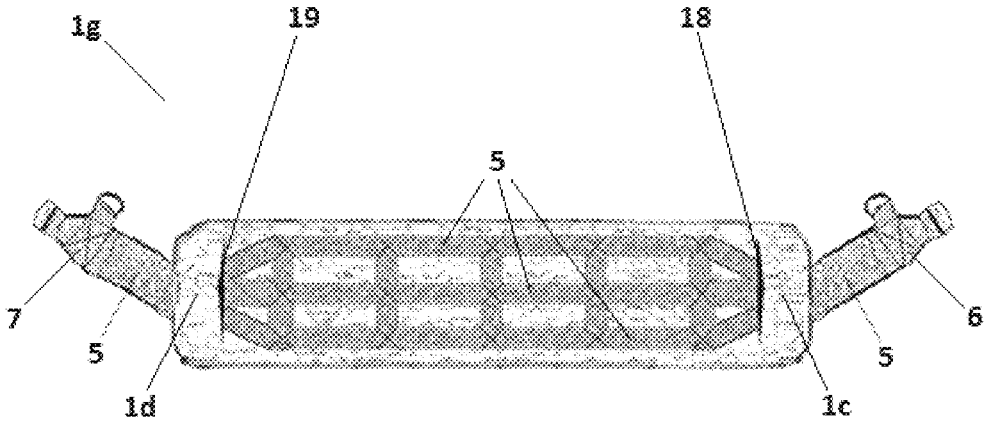
FIG. 4 is a view of the fanny pack's outer layer from the inner layers perspective, and with the inner layer removed to show the incorporation of a support strap with the fanny pack.

FIG. 4 shows the fanny pack's outer layer 1*g*, shown from the inner layer perspective, and with the inner layer removed to show the incorporation of a length of strap-like webbing (here and after known as a support strap 5) having a first end 6 and a second end 7. Each of the first and second ends 6 and 7 of the support strap 5 includes additional features which are further shown and defined in FIG. 7. The support strap 5 is contained within the shared interior space created by the inner and outer layer attachment when the inner layer is included. Additionally, the figure shows the support strap ends 6 and 7 passing through support strap exit openings 18 and 19, respectively, located within the outer layer 1*g*, and near each side 1*c* and 1*d*. The support strap exit openings 18 and 19 are located behind compartments located on the outer layer 1*g*, which are shown and defined in FIGS. 6A and 7. The location of the support strap exit openings 18 and 19 enable the support strap ends 6 and 7 to enter from behind and terminate within the interior of said compartments when stowed, or to pass through and exit the compartments as shown, and as further shown and defined in FIGS. 6A and 7. It is envisioned that the support strap may be of any flexible material suitable for use, such as webbing, cord, leather and etc.

Figure 5:
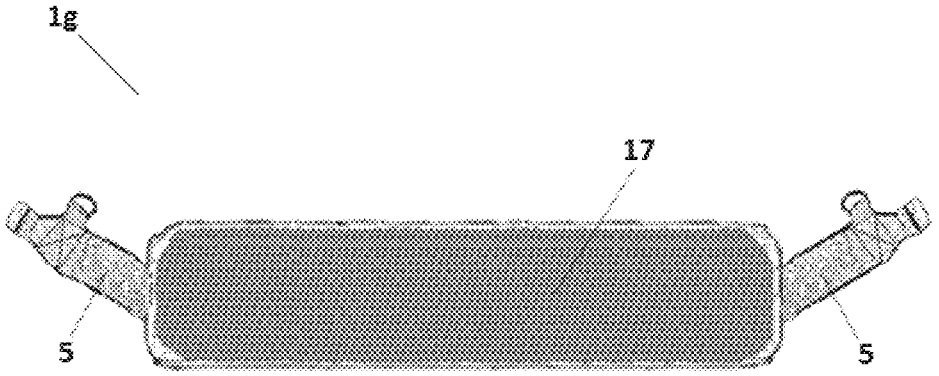
FIG. 5 is a view of the fanny pack's outer layer from the inner layers perspective, and with the inner layer removed to show the incorporation of a padding material with the fanny pack.

FIG. 5 shows the fanny pack's outer layer 1*g*, shown from the inner layer perspective, and with the inner layer removed to show the incorporation of a padding material 17 included with and covering the incorporated support strap 5. It is envisioned that the padding material may be of any flexible material suitable for use, such as foam, rubber, fabric, and etc.

Figure 6:
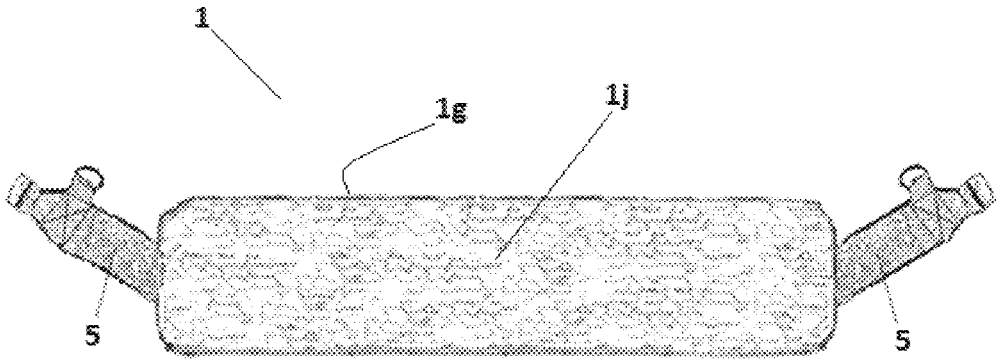
FIG. 6 is a view of the fanny pack from the inner layers perspective, and with the inner layer included to show the result of the incorporation of the support strap and padding material with the fanny pack.

FIG. 6 shows the fanny pack 1, shown from the inner layer 1*j* perspective, and with the outer layer 1*g* facing away. The fanny pack's inner layer 1*j* is shown covering the incorporated support strap 5 and the padding material.

Figure 6A:
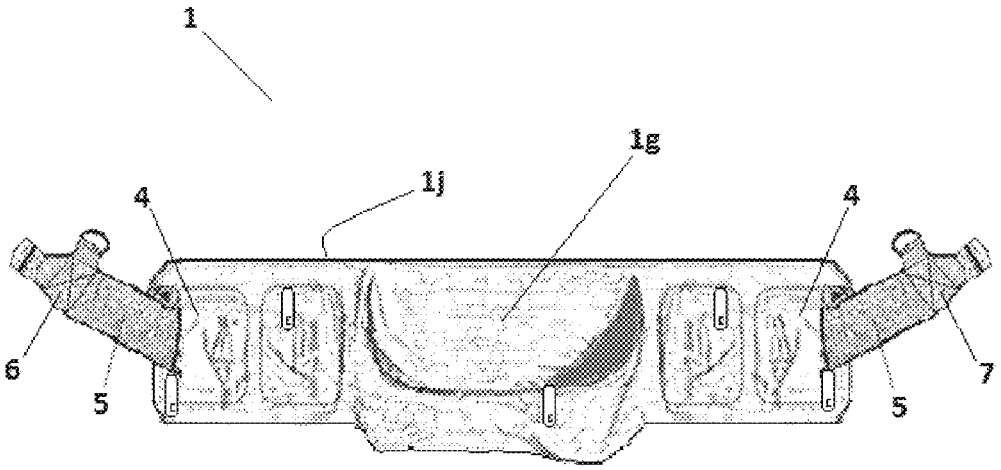
FIG. 6A is a view of the fanny pack from the outer layers perspective, to show the result of the incorporation of the support strap and padding material with the fanny pack.

FIG. 6A shows the fanny pack 1, shown from the outer layer 1*g* perspective, and with the inner layer 1*j* facing away. The fanny pack's outer layer 1*g* is shown with the support strap ends 6 and 7 of support strap 5 having been passed through and now exiting from their respective compartments 4.

Figure 7:
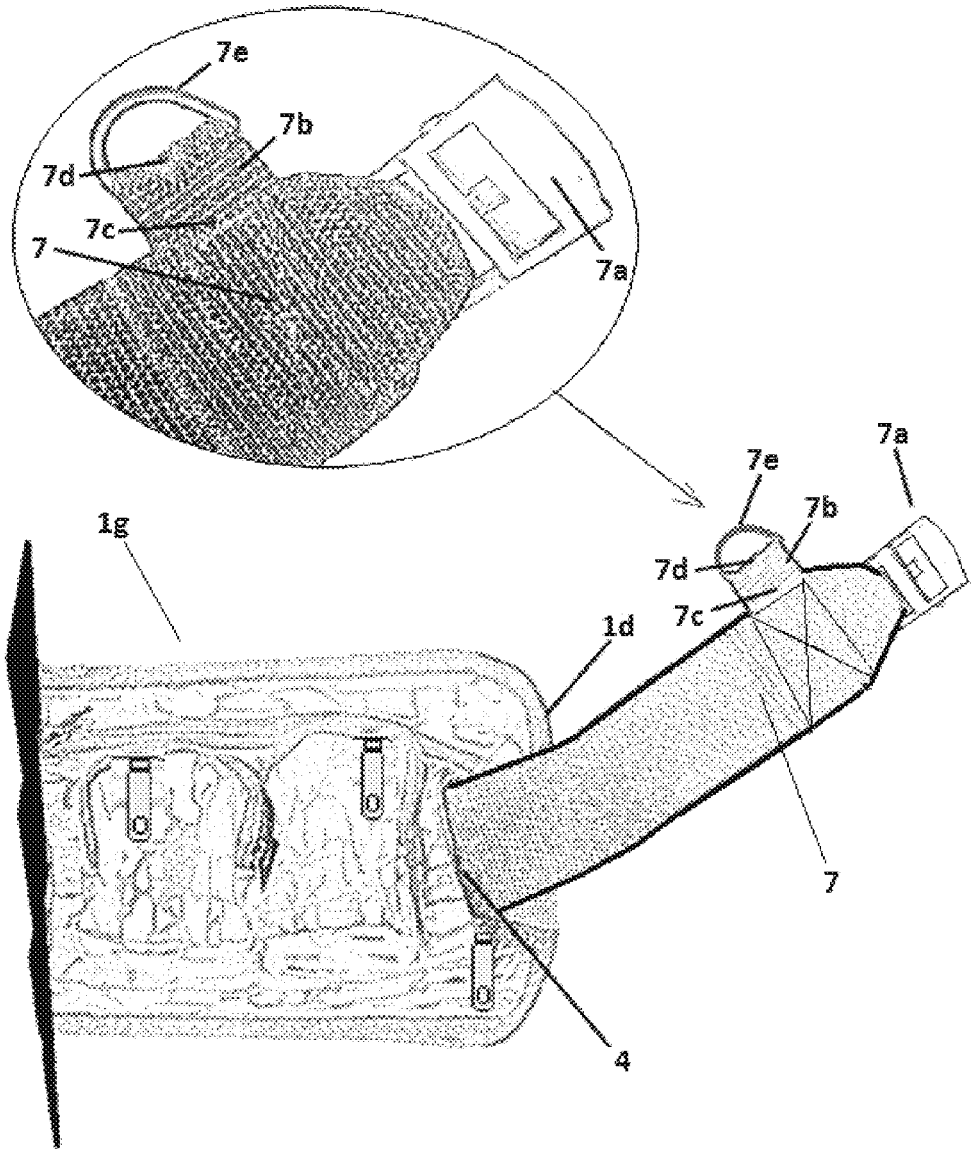
FIG. 7 is a view of one of the fanny pack's sides from the outer layer perspective, and details the incorporated support strap end exiting from the respective compartment.

FIG. 7 shows the fanny pack's side 1*d*, and from the perspective of the outer layer 1*g*. The figure shows the second support strap end 7 having been passed through and now exiting its respective compartment 4, and details the additional features of the second support strap end 7 which is including the attachment of an adjustable support strap mechanism 7*a*, such as a cam buckle, a strap adjuster, a spring buckle adjuster, and etc. The support strap mechanism 7*a* is capable of being united with an additional strap end, as shown and defined in FIG. 10. Additionally, the second support strap end 7 includes a length of strap-like webbing (here and after known as a ring strap 7*b*) having a first end 7*c* and second end 7*d*. The first end 7*c* is attached to support strap end 7, and the second end 7*d*, is shown including an attached ring hardware 7*e*, such as a D-ring, an O-ring, a loop ring, and etc. The ring hardware 7*e* is capable of being united with a backrest attachment mechanism, as shown and defined in FIG. 13. The opposite, remaining fanny pack side (not shown in this figure) appears and operates the same by utilizing another compartment, and the first support strap end with its adjustable support strap mechanism, ring strap, and ring hardware. It is envisioned that the adjustable support strap mechanisms and ring hardware may be of any design, and made from any material suitable for use. It is also envisioned that the ring straps may be of any flexible material suitable for use, such as webbing, cord, leather and etc.

Figure 8:
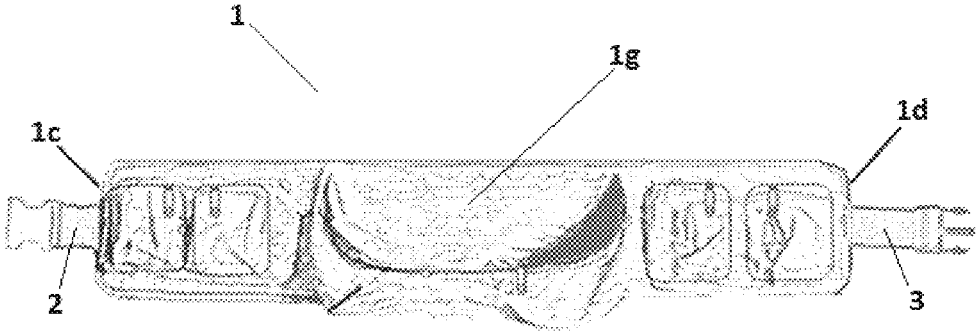
FIG. 8 is a view of the fanny pack from the outer layers perspective, to show the attachment of belt straps.

FIG. 8 shows the fanny pack 1, shown from the outer layer 1*g* perspective, and including two lengths of strap-like webbing (here and after known as belt straps 2 and 3) which are attached at each short side 1*c* and 1*d*, respectively, of the fanny pack. The belt straps 2 and 3 are further shown and defined in FIG. 8A.

Figure 8A:
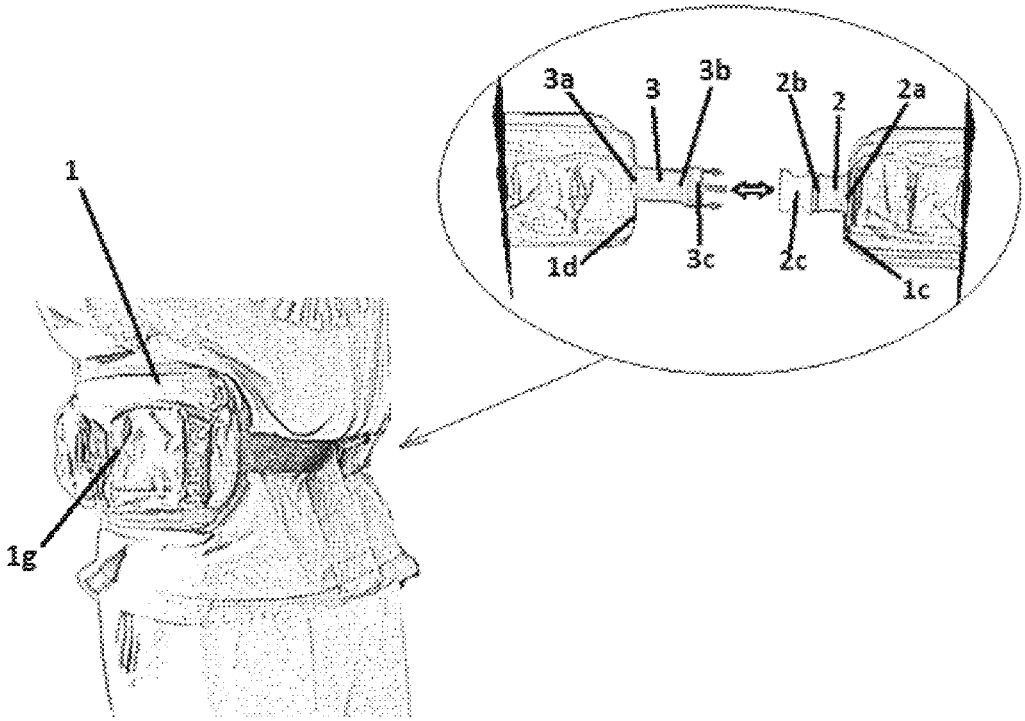
FIG. 8*a* is a view of the fanny pack from the outer layers perspective, and further details the attached belt straps, and provides an example of a waist-worn configuration.

FIG. 8A shows the fanny 1 having been wrapped around a user's waist and connected to itself in a belt-like manner, and in a preferred configuration having the outer layer 1*g* facing out and away from the user. The figure also shows the belt straps 2 and 3, where each belt strap includes a first end and a second end. The belt strap's first ends 2*a* and 3*a* are each attached to a short side of the fanny pack, 1*c* and 1*d*, respectively. The belt strap's second ends 2*b* and 3*b* each include an adjustable belt connecting mechanism 2*c* and 3*c*, such as a side-release buckle, a military buckle, a belt buckle, and etc. The adjustability of the belt straps 2 and 3 to fit different size waists is accomplished by any known manner, such as increasing or decreasing the amount of length of belt strap second end 2*b* and/or 3*b* which passes through the adjustable belt connecting mechanism 2*c* and/or 3*c*. It is envisioned that the belt straps may be of any material suitable for use, such as webbing, cord, leather and etc., and the adjustable belt connecting mechanisms may be of any design, and made from any material suitable for use.

Figure 9:
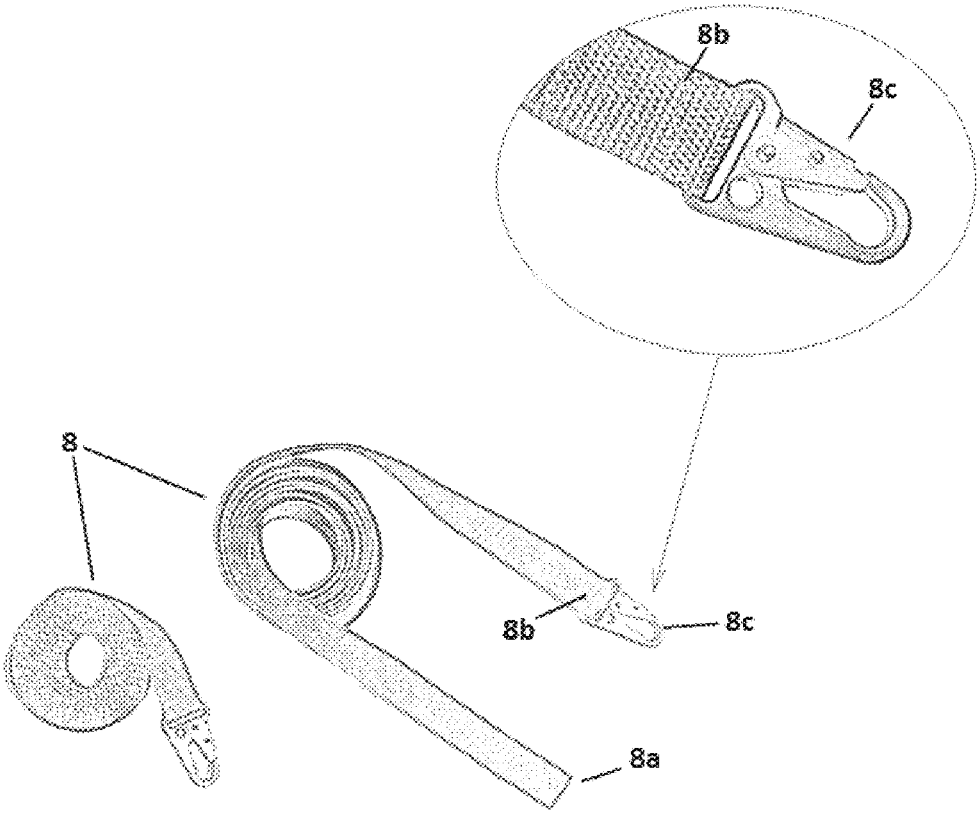
FIG. 9 is a view of the suspension straps, and details one of the suspension straps.

FIG. 9 shows two lengths of strap-like webbing (here and after known as suspension straps 8), each having a first end 8*a* and a second end 8*b*. The first end 8*a* does not require nor include additional features. The second end 8*b* includes an attached suspension strap mechanism 8*c*, such as a snap hook, a spring link, a carabiner, and etc., which is capable of being opened to receive and capture the entire width of the suspension strap, while allowing the captured suspension strap to slide freely through and within the closed mechanism. Each of the two suspension straps 8 are of identical design, and are interchangeable when being utilized. It is envisioned that the suspension straps may be of any flexible material suitable for use, such as webbing, cord, leather and etc., and the attached suspension strap mechanisms may be of any design, and made from any material suitable for use.

Figure 10:
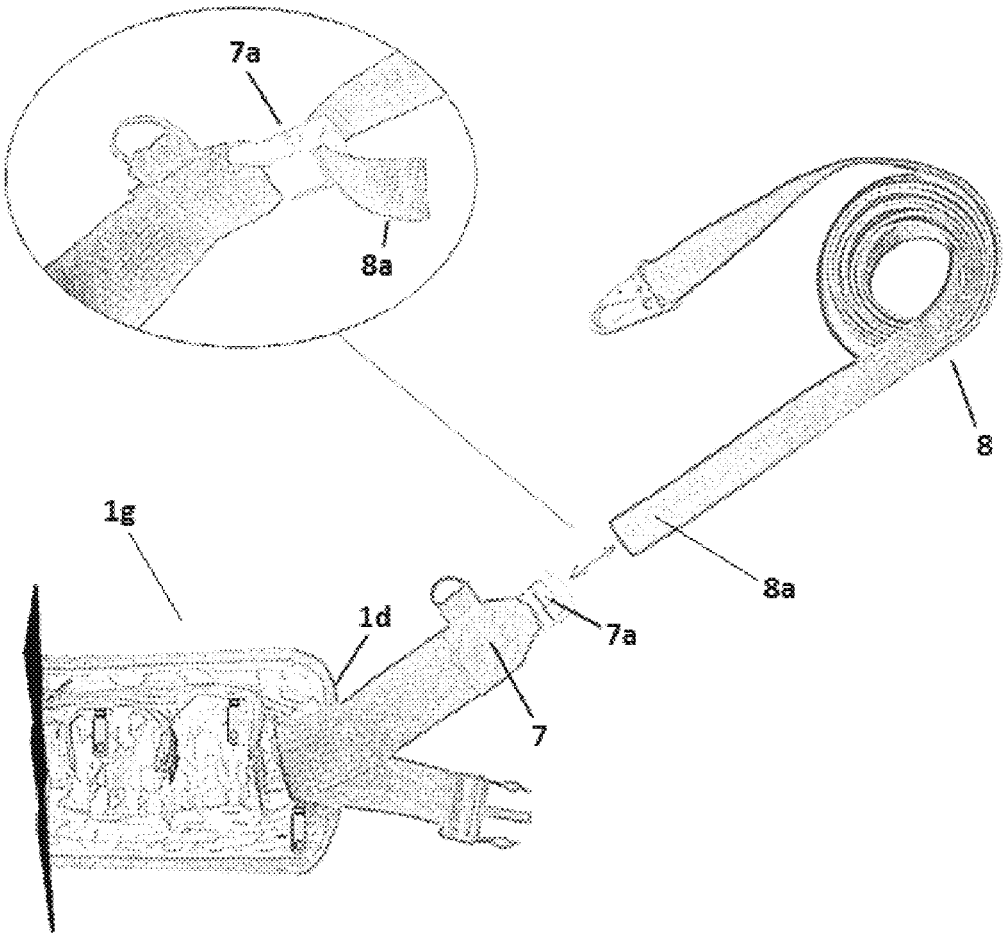
FIG. 10 is a view of one of the fanny pack's sides from the outer layer perspective, and provides detail of a support strap being united with a suspension strap.

FIG. 10 shows the fanny pack's side 1*d*, and from the perspective of the outer layer 1*g*. The figure shows the second support strap end 7, including the support strap mechanism 7*a*, which is being united with the first end 8*a* of one of the suspension straps 8. The support strap mechanism 7*a* is capable of being opened to receive the suspension strap end 8*a*, and then closed at any point along the length of the suspension strap 8 in order to hold and secure the suspension strap 8 at a desired position. The opposite, remaining fanny pack side (not shown in this figure) appears and operates the same by utilizing the first support strap end with its support strap mechanism, and with the other suspension strap.

Figure 11:
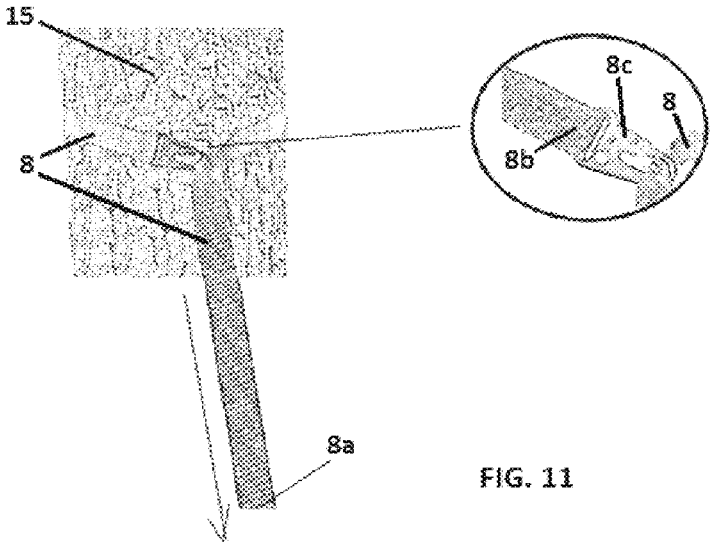
FIG. 11 is a view of one of the suspension straps being attached to a fixed object.

FIG. 11 shows a suspension strap 8, the suspension strap's end 8*b*, and shows the suspension strap's mechanism 8*c* being united with the suspension strap in order to attach the suspension strap to a fixed object 15, such as a tree, as shown. The suspension strap 8 is attached to the fixed object 15 by having the suspension strap mechanism 8*c* travel around the entire circumference of the fixed object 15, resulting in the ability to unite the suspension strap mechanism 8*c* with its own suspension strap 8. This is achieved by opening the suspension strap mechanism 8*c*, inserting the width of the suspension strap 8 into the opened suspension strap mechanism 8*c*, and then closing the suspension strap mechanism 8*c* in order to capture the suspension strap 8. By pulling the suspension strap's first end 8*a* down and away from the point of the attachment to the fixed object 15, the suspension strap 8 slides through and within the closed suspension strap mechanism 8*c* until a cinching or choking action is achieved, resulting in the suspension strap 8 being tightened around and against the fixed object 15. The other suspension strap is attached to a fixed object in the same fashion.

Figure 11A:
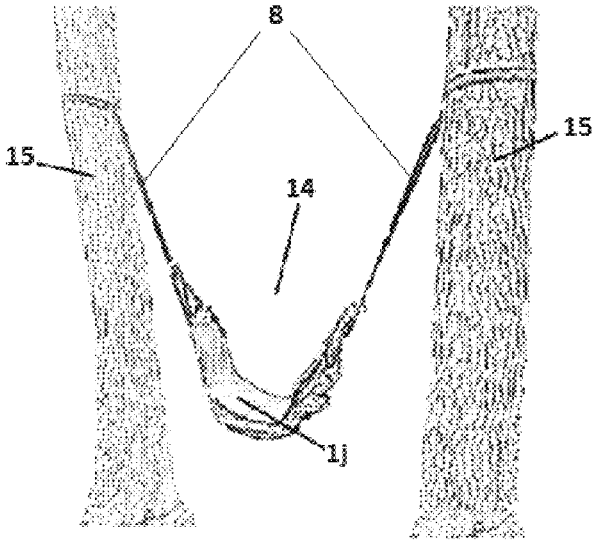
FIG. 11A is a view of both suspension straps attached to two fixed objects, and the resulting sling-like seat.

FIG. 11A shows both suspension straps 8 having been attached to two fixed objects 15, such as two trees, as shown. The fanny pack's inner layer 1*j* is facing up and will be utilized and serve the purpose as the seating surface of a sling-like seat 14.

Figure 11B:
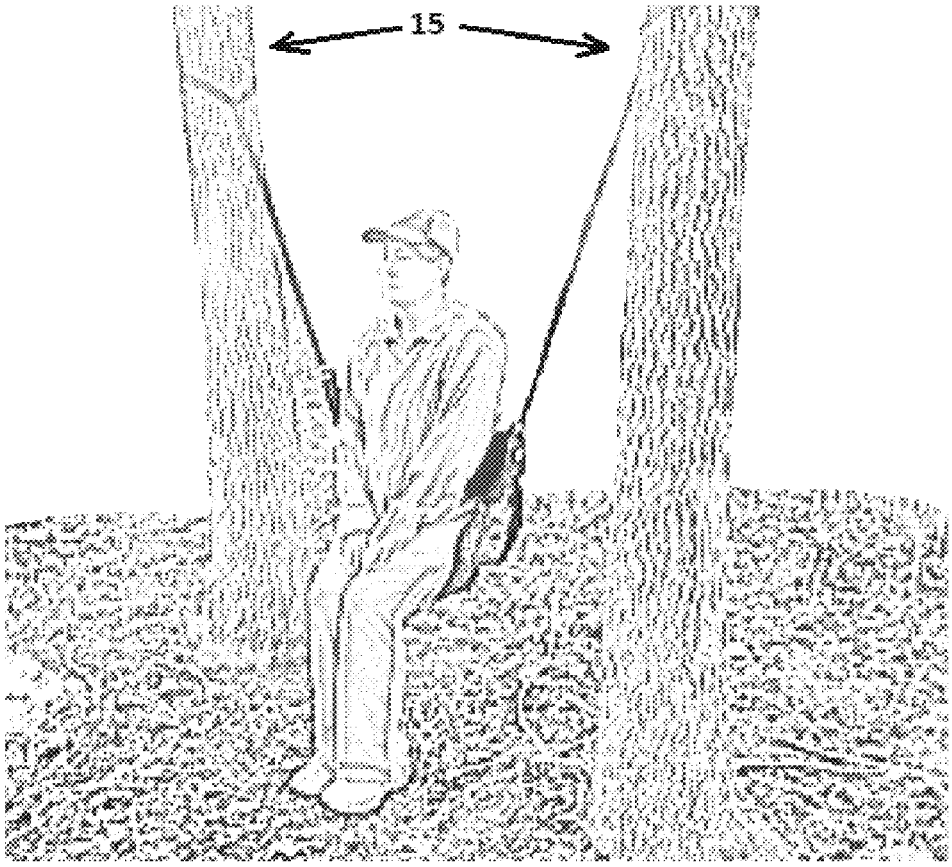
FIG. 11B is a view of a user utilizing two fixed objects to enable the use of the sling-like seat.

FIG. 11B shows an example of the fanny pack being utilized and serving the purpose of providing the user with a sling-like seat when two fixed objects 15 were selected, such as two trees.

Figure 11C:
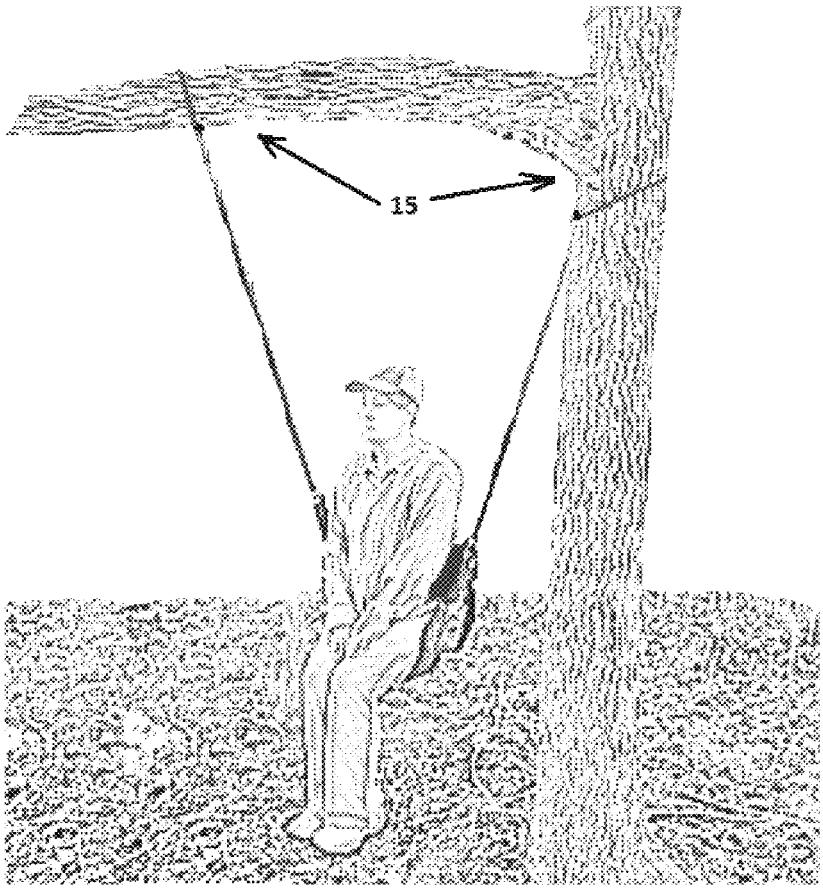
FIG. 11C is a view of another example of user utilizing two fixed objects to enable the use of the sling-like seat.

FIG. 11C shows an example of the fanny pack being utilized and serving the purpose of providing the user with a sling-like seat when two fixed objects 15 were selected, such as a tree and its branch.

Figure 11D:
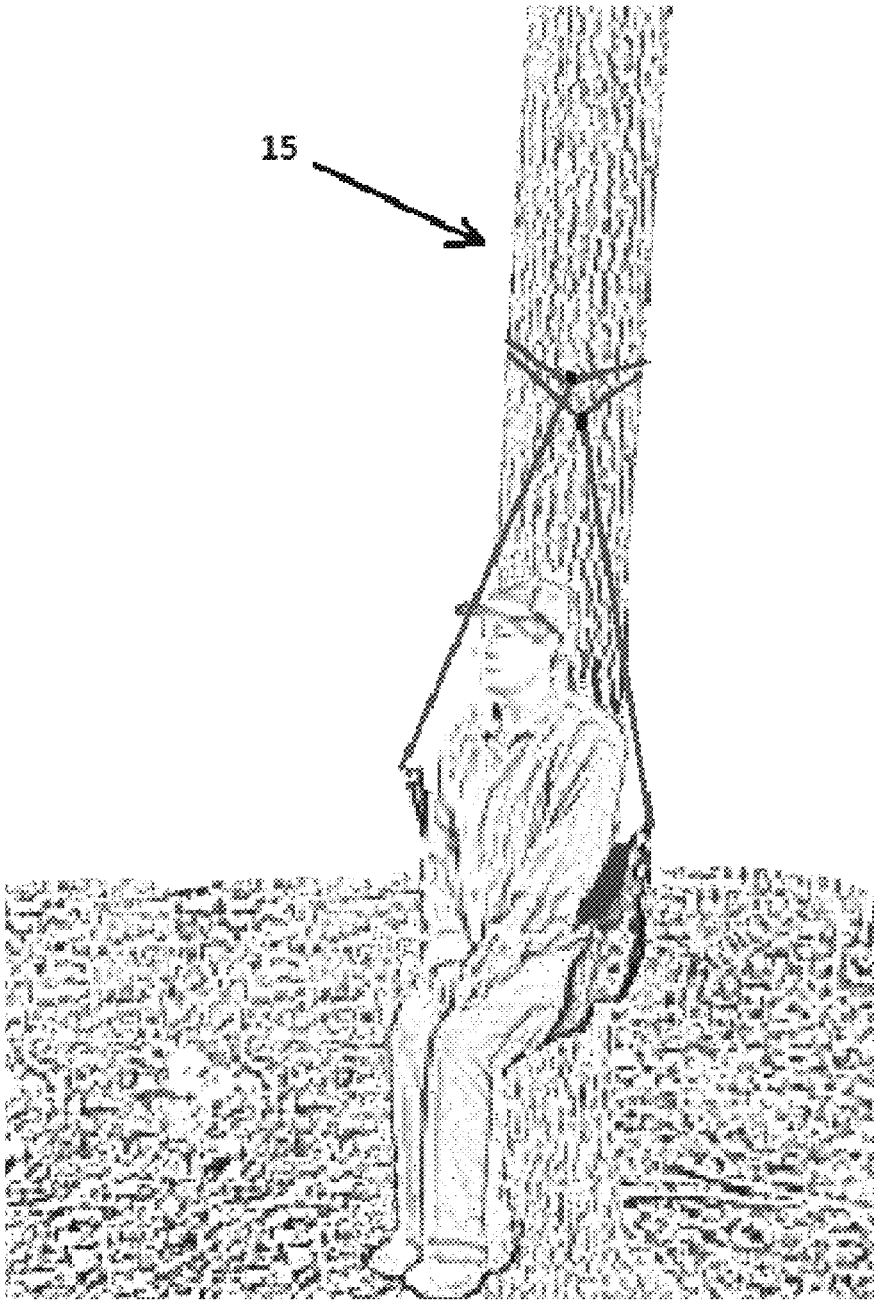
FIG. 11D is a view of a user utilizing one fixed object to enable the use of the sling-like seat.

FIG. 11D shows an example of the fanny pack being utilized and serving the purpose of providing the user with a sling-like seat when one fixed object 15 was selected, such as a single tree.

Figure 12:
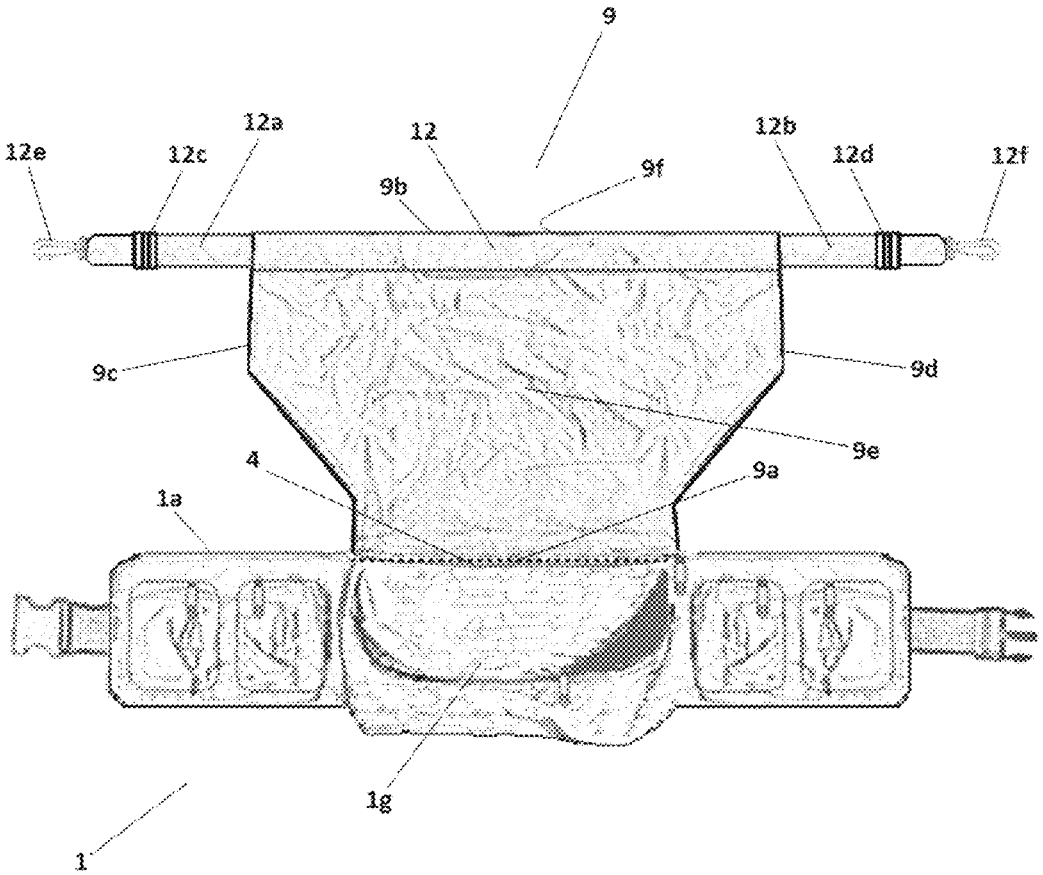
FIG. 12 is a view of the fanny pack from the outer layers perspective, and details the attached backrest.

FIG. 12 shows the fanny pack 1, shown from the outer layer 1*g* perspective, and shows the fanny pack comprising a backrest 9 consisting of a four-sided, flexible material. The four sides are connected in such a way as to create an outer surface 9*e* and an inner surface 9*f* of the backrest 9. The surfaces are defined as such according to the attachment of the backrest 9 to the outer layer 1*g*, and become further evident according to the position of a seated user. The backrest side 9*a* is considered as the bottom side, and is attached to the fanny pack 1 within a compartment 4, which is located at the fanny packs side 1*a*. The point of attachment is represented in the figure as a segmented line. The attachment within the compartment allows the backrest to be rolled up and stowed in the compartment when not in use. The backrest side 9*b* includes an attached strap-like webbing (here and after known as a backrest strap 12), having a first end 12*a* and a second end 12*b*. The backrest strap 12 is running the entire length of the backrest side 9*b*, with the backrest strap ends 12*a* and 12*b* extending off each backrest side 9*c* and 9*d*, respectively. Each of the backrest strap's first and second ends 12*a* and 12*b*, includes an attached backrest adjusting mechanism 12*c* and 12*d*, respectively, such as a strap adjuster, a strap slide, a clasp buckle, and etc. The backrest adjusting mechanisms 12*c* and 12*d* are capable of adjusting the backrest strap length to allow the backrest to conform to the seated user. Additionally, the backrest strap ends 12*a* and 12*b* terminate with attached backrest attachment mechanisms 12*e* and 12*f*, respectively, such as a snap hook, a spring link, a carabiner, and etc. The backrest attachment mechanisms 12*e* and 12*f* are capable of being united with the ring hardware incorporated with the support strap ends, as shown and defined in FIG. 13. It is envisioned that the backrest attachment mechanisms 12*e* and 12*f*, may be of a design that offers the capability of strap length adjustment, aiding in the capability of, or eliminating the need for, the backrest adjustment mechanisms, 12*c* and 12*d*. It is also envisioned that the attachment of the backrest to the outer layer may be of any design suitable for use, such as stitching, gluing, bonding, zippers, hook/loop fastener material, snaps, and etc. It is also envisioned that the backrest may be of any material suitable for use, such as fabric, canvas, nylon, and etc., and the backrest adjusting mechanisms and backrest attachment mechanisms may be of any design, and made from any material suitable for use.

Figure 13:
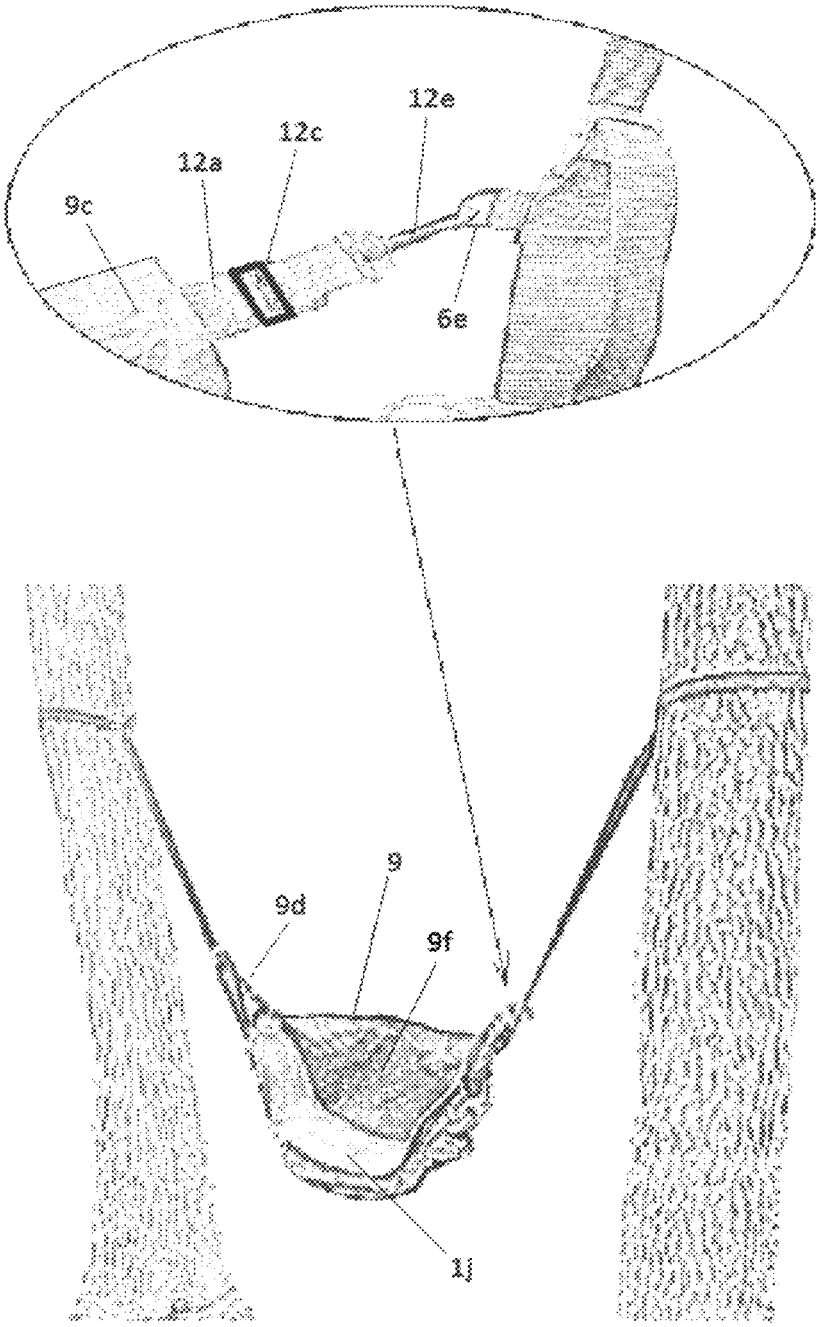
FIG. 13 is a view of the fanny pack from the established sling-like seat perspective, and with the backrest deployed and in operation, and provides detail of a backrest strap end being united with a ring hardware.

FIG. 13 shows the deployment and configuration of the backrest 9, and shows the backrest's side 9*c*. The backrest's side 9*c* includes the first backrest strap end 12*a*, the backrest adjustable mechanism 12*c*, and backrest attachment mechanism 12*e*, as previously shown and defined. Additionally, the figure shows the backrest attachment mechanism 12*e* being united with the ring hardware 6*e*, which was previously shown and defined. The opposite, remaining backrest side 9*d* appears and operates the same by utilizing the second backrest strap end, its backrest adjustable mechanism, its backrest attachment mechanism, and the other ring hardware. The figure also shows the resulting configuration with the backrest 9 fully deployed and connected as defined above, with the backrest's inner surface 9*f* in position to support a seated user, and with the fanny pack's inner layer 1*j* being utilized as a seating surface.

Figure 14:
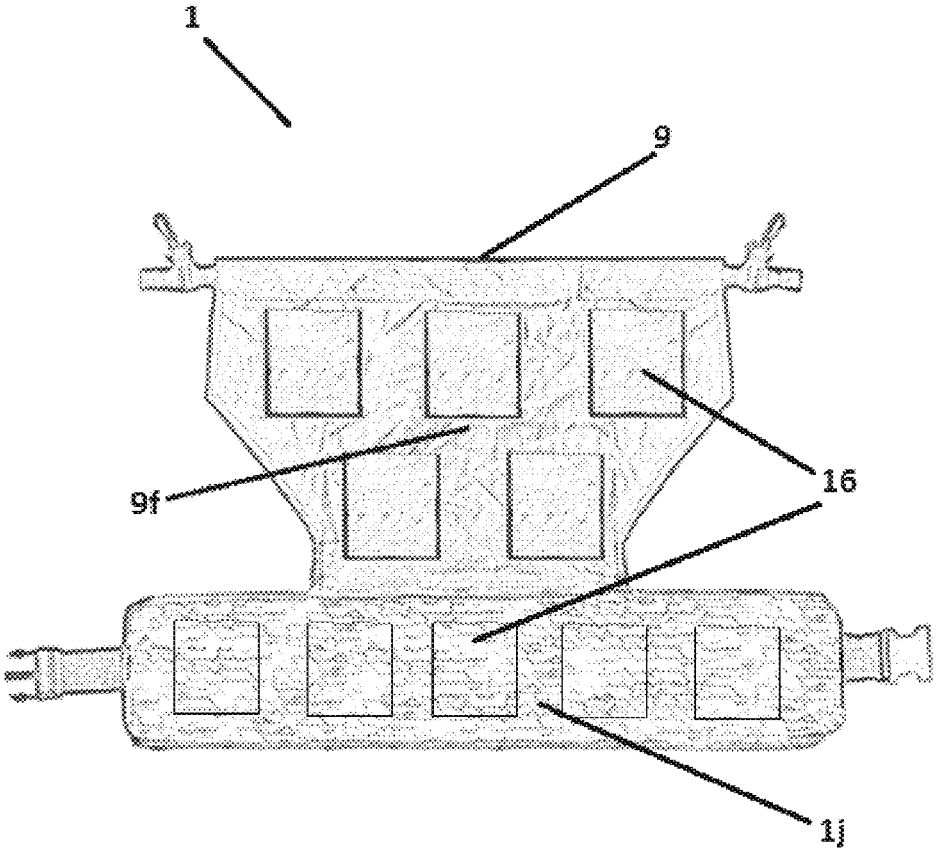
FIG. 14 is a view of the fanny pack from the inner layers perspective, with the backrest deployed and showing the inner surface, and details the incorporated heat pack pockets.

FIG. 14 shows the fanny pack 1, shown from the inner layer 1*j* perspective, and with backrest 9 deployed and showing its inner surface 9*f*. The figure shows an example of a configuration of pockets and/or compartments 16 which are capable of receiving heat generating packs to serve the purpose of providing warmth, comfort, and/or therapeutic relief to the seated user. For example, at least one pocket and/or compartment 16 may be included with the inner layer 1*j* to receive a heat pack, which can give therapeutic relief to a user's lower back when wearing the device as a fanny pack, and alternately, providing warmth to a user's bottom and lower extremities while using the device in a seated position. It is envisioned that the pockets and/or compartments may be of any material suitable for use, such as fabric, canvas, nylon, and etc., and may be opened and closed by means of zippers, hook/loop fastener material, snaps, and etc., and may be located on any side, surface, and/or layer of the fanny pack.

Figure 15:
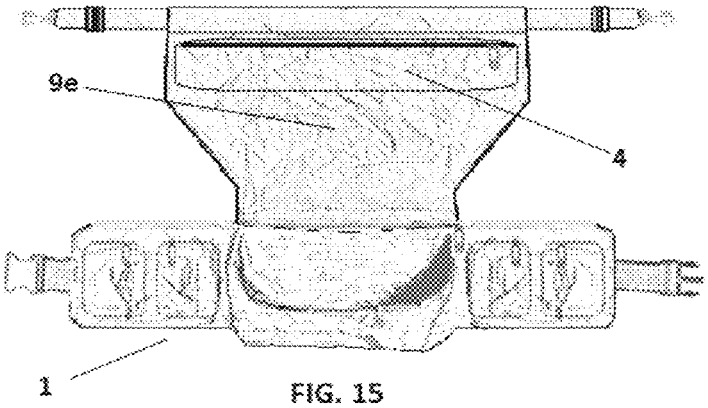
FIG. 15 is a view of the fanny pack's backrest from the outer surface perspective, and shows the compartment containing a multifunctional material.

FIG. 15 shows the fanny pack 1, shown from the perspective of the backrests outer surface 9*e*, and shows a compartment 4 used to contain and stow a flexible, multifunctional material when not in use.

Figure 16:
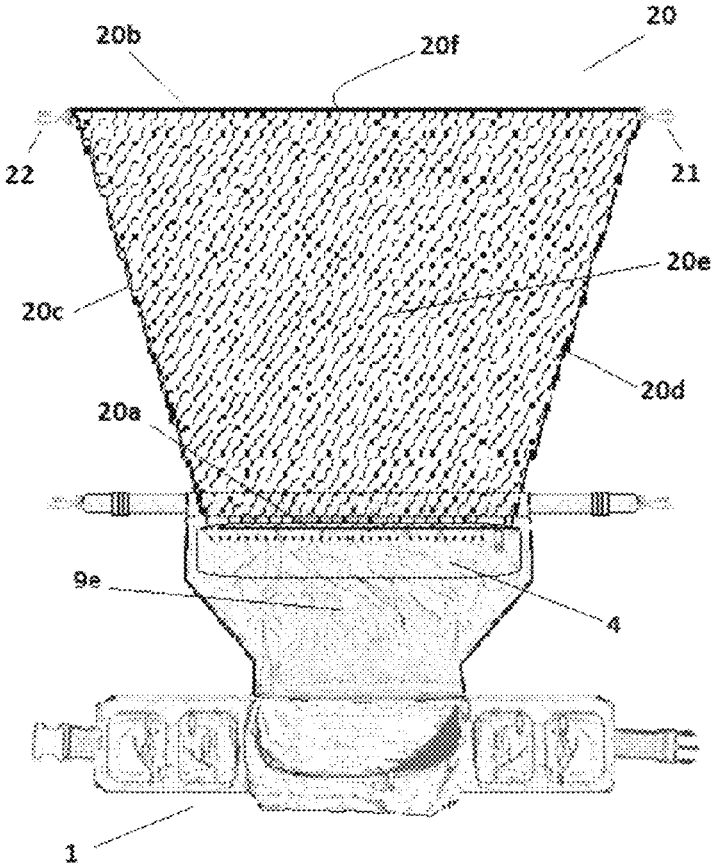
FIG. 16 is a view of the fanny pack's backrest from the outer surface perspective, and shows the multifunctional material deployed from its compartment.

FIG. 16 shows the fanny pack 1, shown from the perspective of the backrests outer surface 9*e*, and shows the multifunctional material 20 deployed from its compartment 4. The multifunctional material is shown having two short sides 20*a* and 20*b*, and two long sides 20*c* and 20*d*. The four sides are connected in such a way as to create an outer surface 20*e* and an inner surface 20*f* of the multifunctional material 20. The surfaces are defined as such according to the attachment of the multifunctional material 20 to the backrest 9, and become further evident according to the position of a seated user. The multifunctional materials short side 20*a* is considered as the bottom side, and is attached to the backrest 9 within said compartment 4. The point of attachment is represented in the figure as a segmented line. The attachment within the compartment allows the multifunctional material to be rolled up and stowed within the compartment when not in use. The multifunctional material 20 is shown including material attachment mechanisms 21 and 22. The material attachment mechanisms 21 and 22 enable the user to employ and attach the multifunctional material to any available attachment points, such as attaching each material attachment mechanism 21 and 22 at any point along the length of the suspension straps in order to suspend the multifunctional material 20 behind the seated user. It is envisioned that the material attachment mechanisms may be of any design suitable for use, such as clips, snap hooks, spring links, carabiners, and etc., and may be of a design that enables removal and relocation at any point along the sides and/or surfaces of the multifunctional material to provide alternative attachment and configuration options, such as double-headed clips, snap hooks, spring links, carabiners, and etc. It is also envisioned that the attachment of the multifunctional material to the backrest may be of any design suitable for use, such as stitching, gluing, bonding, zippers, hook/loop fastener material, snaps, and etc.

Figure 17:
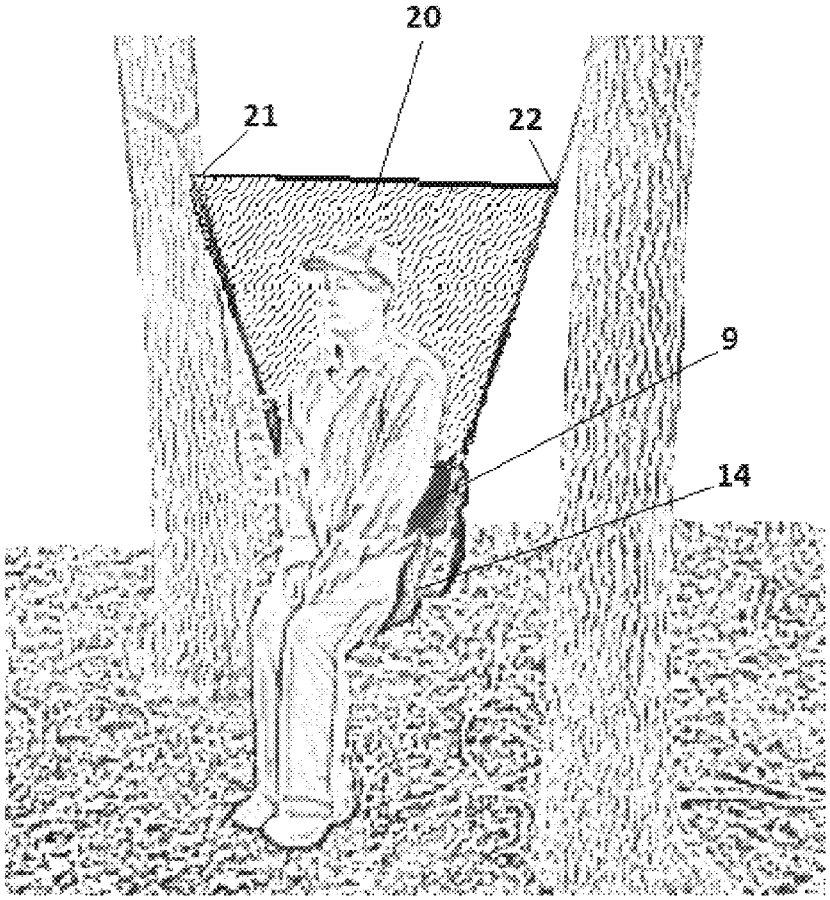
FIG. 17 is a view of the fanny pack from the established sling-like seat perspective, and with the backrest deployed and in operation, and with the multifunctional material deployed and attached to the suspension straps to show one example of configuration.

FIG. 17 shows an example of the fanny pack being utilized and serving the purpose of providing the user with a sling-like seat 14, with the backrest 9 utilized, and shows the deployment and utilization of the multifunctional material 20 and material attachment mechanisms 21 and 22. The figure depicts only one option of configuration of the multifunctional material positioning, such as a backdrop to provide camouflage, a wind break, and/or an extension of the backrest to further support the seated user. It is envisioned that the multifunctional material may be of any material or combination of materials suitable for use, such as netting, fabric, canvas, nylon, and etc., and may be of any thickness, size, and shape to support the intended use. For example, the multifunctional material could alternatively be of a size and shape that would allow a user to attach and/or drape the material over their seated position providing protection from insects, such as mosquitoes, and/or could be a water proof material to provide a water shed to protect the seated user from weather, such as rain, and/or could be an insulating material to protect the user from temperature, such as heat or cold. The multifunctional material may include the use of additional material attachment mechanisms and/or a length or lengths of webbing, cord, rope, bungee-cord, shock cord, and etc. in order to support a desired configuration.

Figure 18:
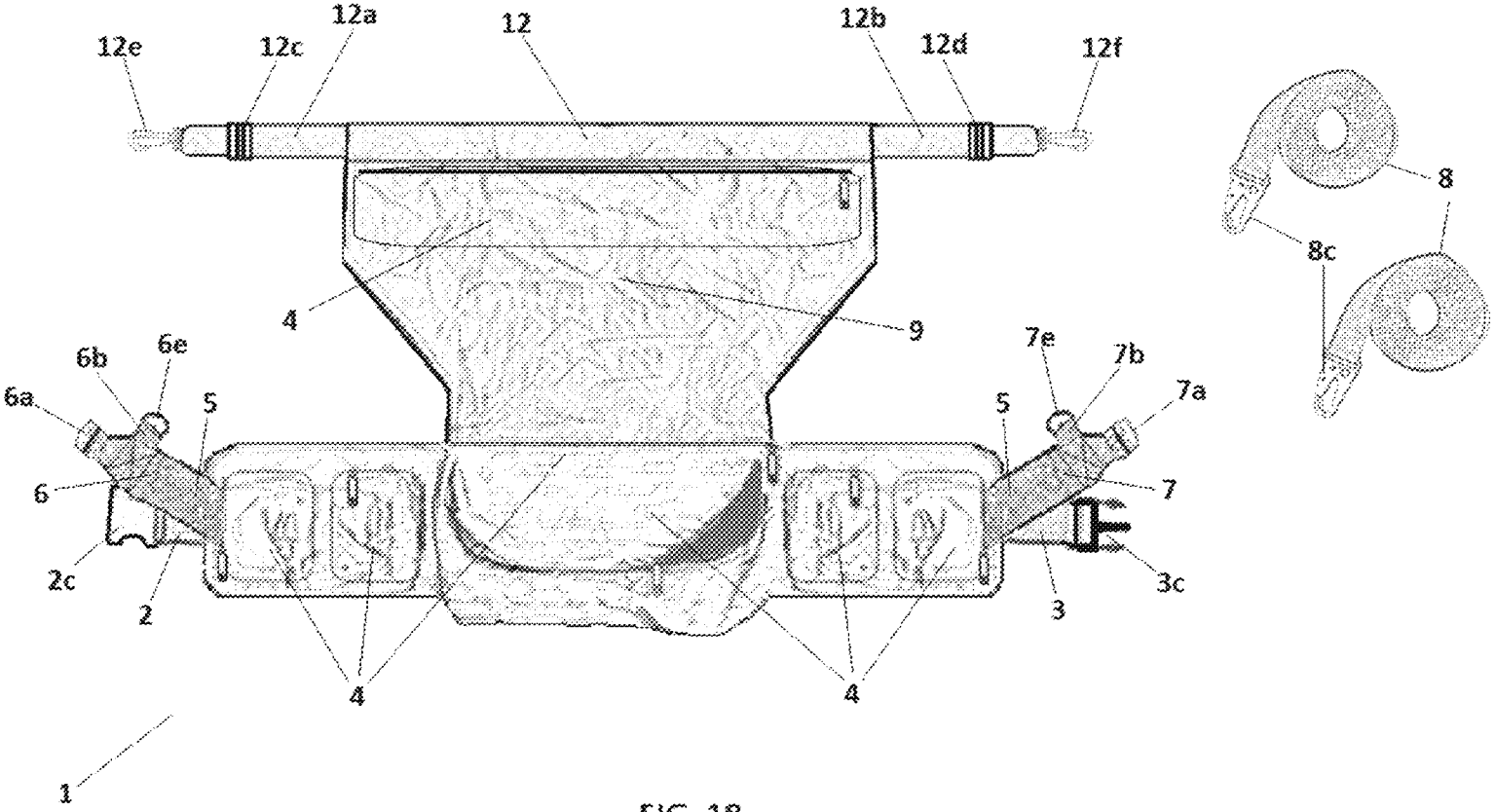
FIG. 18 is a view of a fanny pack from the outer layer perspective, with various components removed and/or deployed providing an overall view.

FIG. 18 shows an overview of the fanny pack 1 with various components opened, deployed and removed. Each of the components shown have been shown and defined in the previous figures. The fanny pack 1 is shown comprising; belt straps 2 and 3, adjustable belt connecting mechanism 2*c* and 3*c*, compartments 4, support strap 5, support strap ends 6 and 7, adjustable support strap mechanisms 6*a* and 7*a*, ring straps 6*b* and 7*b*, ring hardware 6*e* and 7*e*, suspension straps 8, suspension strap mechanisms 8*c*, backrest 9, backrest strap 12, backrest strap ends 12*a* and 12*b*, backrest adjusting mechanisms 12*c* and 12*d*, backrest attachment mechanisms 12*e* and 12*f*.

It is envisioned that the fanny pack described here in could additionally include a lumbar support. For example, the backrest material could be rolled up and stored within its compartment in such a way as to be an effective lumbar support. Additionally, the backrest compartment and/or the shared interior space between the inner and outer layers could contain a bladder in which air could be added and/or removed manually to create lumbar support for the wearer of the fanny pack, and where this bladder could also be removable.

What is claimed is:

1. A multipurpose fanny pack seating system, comprising:

a belt strap having an adjustable belt connecting mechanism enabling a user to attach and wear the multipurpose fanny pack about the waist;

a first elongated layer of flexible material comprised of 2 long sides and 2 short sides which form an elongated outer surface and an elongated inner surface of the first elongated layer, and where said first elongated layer is an outer layer;

a second elongated layer of flexible material comprised of 2 long sides and 2 short sides which form an elongated outer surface and an elongated inner surface of the second elongated layer, and where said second elongated layer is an inner layer;

an attachment of the outer layer and inner layer at and along the long sides and the short sides of the outer layer and inner layer in such a way as to create a shared interior space between the elongated inner surfaces of the outer layer and inner layer, and thereby creating a multipurpose fanny pack outer surface and a multipurpose fanny pack inner surface of the multipurpose fanny pack;

a long webbing support strap having a first end and a second end, and where the long webbing support strap runs lengthwise through the shared interior space between the outer layer and the inner layer, and where each of the first end and second end contain an adjustable support strap mechanism, a ring strap, and a ring hardware, and where the first end and the second end of the long webbing support strap exit the shared interior space through support strap exit openings located near each of the short sides of the outer layer, and having the support strap exit openings located behind and inside compartments which contain the first end and the second end of the long webbing support strap when not in use, and release the first end and the second end of the long webbing support strap when the multipurpose fanny pack seating system is utilized;

a padding material, and where the padding material is contained within said shared interior space, and in between the support strap and the multipurpose fanny pack inner surface providing cushion for the suspended and seated user;

the long webbing support strap and at least one long webbing suspension strap, with the at least one long webbing suspension strap having a first end and a second end, where the first end terminates with no additional features, and the second end includes a suspension strap clip mechanism, wherein the first end of the at least one long webbing suspension strap connects to the adjustable support strap mechanism, and the second end of the at least one long webbing suspension strap connects to a fixed object via the suspension strap clip mechanism, thereby providing a user with the multipurpose fanny pack seating system suspended from the fixed object or objects.

2. The multipurpose fanny pack seating system of claim 1, further comprising compartments attached to at least the said multipurpose fanny pack outer surface, and where the compartments carry and stow items, and contain and release components of the multipurpose fanny pack seating system.

3. The multipurpose fanny pack seating system of claim 2, further comprising a deployable backrest wherein the deployable backrest is attached and contained within one of said compartments when not in use.

4. The multipurpose fanny pack seating system of claim 3, wherein when the attached and contained deployable backrest is not in use and serves as a lumbar support when the multipurpose fanny pack is worn about the waist.

5. The multipurpose fanny pack seating system of claim 1, further comprising compartments attached to at least the said multipurpose fanny pack inner surface, and where the compartments carry and stow items, and contain and release components of the multipurpose fanny pack seating system.

6. The multipurpose fanny pack seating system of claim 5, further comprising heat packs contained in at least one said compartments, wherein the compartments are located in such a way as to provide the user with warmth and therapeutic relief to the user's bottom while the user is utilizing the multipurpose fanny pack seating system and in the seated position.

7. The multipurpose fanny pack seating system of claim 1, further comprising a deployable backrest that is utilized when the user is in a suspended, seated position.

8. The multipurpose fanny pack seating system of claim 7, wherein the deployable backrest includes at least one compartment.

9. The multipurpose fanny pack seating system of claim 8, wherein the multifunctional material is attached and contained in one of the compartments of the deployable backrest when not in use.

10. The multipurpose fanny pack seating system of claim 8, wherein the deployable backrest contains heat packs in at least one of said compartments, wherein the compartments are located in such a way as to provide the user with warmth and therapeutic relief to the user's back and waistline while the user is utilizing the multipurpose fanny pack seating system and in the seated position.

11. The multipurpose fanny pack seating system of claim 7, further comprising a deployable multifunctional material, and where the deployed multifunctional material serves to provide the user with an extension of the backrest, camouflage, protection from weather, temperature, and insects.

12. The multipurpose fanny pack seating system of claim 7, wherein the deployable backrest includes a long webbing backrest strap having a first end and a second end, wherein each end includes a backrest attachment mechanism, and wherein each end includes a backrest adjusting mechanism.

* * * * *